United States Patent [19]

Spohr et al.

[11] Patent Number: 5,067,544

[45] Date of Patent: Nov. 26, 1991

[54] WORM DRIVE FOR SETTING THE ANGULAR POSITION OF VERTICAL LAMELLA BLINDS

[75] Inventors: Horst Spohr, Cuxhaven; Walter Huegin, Efringen-Kirchen, both of Fed. Rep. of Germany

[73] Assignee: bautex Adolf Stoever Soehne KG, Fed. Rep. of Germany

[21] Appl. No.: 387,167

[22] Filed: Jul. 28, 1989

[30] Foreign Application Priority Data

Jul. 29, 1988 [DE] Fed. Rep. of Germany ..... 3825978

[51] Int. Cl.[5] ..... E06B 9/38

[52] U.S. Cl. ..... 160/177; 160/900

[58] Field of Search ..... 160/168.1, 176.1, 173, 160/177, 166.1, 900

[56] References Cited

U.S. PATENT DOCUMENTS

| | | | |
|---|---|---|---|
| 4,267,875 | 5/1981 | Koks | 160/176.1 |
| 4,306,608 | 12/1981 | Frentzel et al. | 160/176.1 |
| 4,316,493 | 2/1982 | Arena | 160/168.1 |
| 4,350,197 | 9/1982 | Haller | 160/176.1 X |
| 4,628,981 | 12/1986 | Ciriaci et al. | 160/168.1 X |
| 4,736,784 | 4/1988 | Boloix | 160/168.1 |
| 4,799,527 | 1/1989 | Villoch et al. | 160/168.1 |

FOREIGN PATENT DOCUMENTS

| | | | |
|---|---|---|---|
| 2145141 | 3/1985 | United Kingdom | 160/176.1 |

*Primary Examiner*—David M. Purol

*Attorney, Agent, or Firm*—Hill, Van Santen, Steadman & Simpson

[57] ABSTRACT

A worm drive for setting the angular position of vertical slat blinds comprising a vertical axis or shaft arranged inside a slat carrier housing and carrying a pinion torsionally connected thereto and having its end side joined to a slat. A worm rotatable by a drive shaft is in drive engagement with the pinion. This worm drive is characterized by a worm having an axial center opening that, given significantly simplified assembly and reduced structural depth of the slat carrier housing, is held by a snap-on sleeve on a projection of the slat carrier housing shaped like a connecting piece. The worm is provided with an inside dentation that is in engagement with cams arranged at the outside circumference of the snap-on sleeve and thus forms a friction clutch that allows a hamrless overturning of the worm as a consequence of the limited transmission of torque.

15 Claims, 3 Drawing Sheets

WORM DRIVE FOR SETTING THE ANGULAR POSITION OF VERTICAL LAMELLA BLINDS

BACKGROUND OF THE INVENTION

The invention is directed to a worm drive for setting the angular position of vertical lamella or slat style blinds comprising a vertical axis or shaft arranged inside a slat carrier housing, this vertical axis or shaft carries a pinion torsionally connected thereto and has its end side joined to a slat, whereby a worm rotatable by a drive shaft via an inside profiling is in drive engagement with the pinion.

Vertical blinds generally serve as sun screen and/or viewing screen for windows. However, they can also be utilized for other purposes such as, for instance, for subdividing or compartmentalizing larger spaces. Their vertically arranged slats are generally composed of textile material and fashioned strip-shaped, each having at least their upper ends secured to a slat carrier and are generally pivotable around a middle longitudinal axis, whereby a common pivoting of all slat of a vertical blind can ensue with a common drive. The slat carriers are generally in a carrying rail and are displaceable along this rail with a drive.

In the open position wherein the window is not covered by the slat, the slat are moved together at one side to practically form a packet, whereby the slat are positioned parallel to one another.

The setting of the angular position of the individual slat, as was already mentioned, ensues with a common drive that generally has the form of a drive shaft that is in positive engagement with worms seated in the slat carrier housings. The vertical axis or shaft at which the slat is held carries a pinion that meshes with the worm, so that the angular position of the slat can be set via the rotation of the drive shaft.

In a known drive of this species, the worm has its two ends seated in the front and in the back wall of the slat carrier housing. For introducing the worm into the housing, the latter must first be spread with a tool. This is not only involved but also frequently leads to breakage of the housing. Over and above this, the bearing of the worm at two end pegs or flanges causes a deep structure of the slat carrier housing. This, in turn, has the disadvantageous consequence that a relatively thick slat packet arises in the open position, i.e., when the slats are brought together. This is undesirable assuming considerable dimensions, particularly given wide windows or large room dividers.

In view of this problem, the object of the invention is to design the worm drive of the species initially cited such that a simple assembly is enabled without the assistance of special tools and excluding the risk of breaking a housing. At the same time, the structural depth of the slat carrier housing should be reduced in order, particularly given a slat packet that is brought together, to reduce the extent thereof in the direction of the carrying rail.

This object is inventively achieved by the features recited in the characterization of the generic claim, whereby the features of the subclaims are referenced with respect to preferred developments of the worm drive of the invention.

SUMMARY OF THE INVENTION

It is provided in the invention that the worm comprises an axial center opening and is held on a connecting-piece-shaped projection of the slat carrier housing with a snap-on sleeve. Due to this design, the assembly can be accomplished in the simplest conceivable way. The worm has its central opening slipped onto the connecting-piece-shaped projection that could also be referred to as hub, whereupon the snap-on sleeve is introduced to hold the worm on the hub in rotatable fashion. The front wall of the housing can be completely eliminated in this structure. In addition to a significantly simplified assembly, a saving of material thus also derives. Finally, another considerable advantage of the design of the invention is in that the worm is now held on a hub and is no longer held on pegs or flanges at its end sides. The structural depth of the slat carrier housing can thereby be considerably reduced so that the space required by the retracted slat packet is considerably diminished.

In accordance with a preferred embodiment of the worm drive of the invention, the worm carries an all-around inside dentation or counterbore that is in engagement with an outside profiling of the snap-on sleeve. The outside profiling engages into the dentation of the worm and transmits the torque from the drive shaft onto the pinion of the vertical axis or shaft via the worm. When encountering a resistance or in the final setting of the slat position, the profiling of the snap-on sleeve slides along the inside dentation of the worm under a defined resistance. A friction clutch is thus formed that allows a harmless overturning of the drive shaft.

The inside dentation of the worm is preferably arranged in an all-around recess, whereas the outside profiling of the snap-on sleeve is formed by cams directed outward from its collar. The collar of the snap-on sleeve is thus capable of retaining the worm on its hub, whereas the cams at the all-around edge engage into the inside dentation of the worm.

The cams are advantageously held at a spring clip that is expediently composed of a part of the collar of the snap-on sleeve that is cut free. The cams can thus yield in radially resilient fashion. The spring power is adequate in order to transmit the required torque for the rotation of the slat. When they encounter a resistance, they resiliently spring over the inside dentation of the worm, so that damage to the drive parts is made possible.

The snap-on sleeve preferably carries hooks held in axial direction that are resilient in radial direction and engage behind the slat carrier housing. Upon insertion of the snap-on sleeve into the connecting-piece-shaped hub, the hooks are resiliently compressed in radially inward direction. In the final position, the hooks radially spring back in outward direction and thus hold the snap-on sleeve and worm fast at the hub of the housing in rotatable fashion.

An all-around recess (i.e., similar to a counterbore) into which the hooks of the snap-on sleeve engage is advantageously provided concentrically relative to the hub at the back side of the housing. The hooks thus do not project beyond the plane of the back housing wall so that they accordingly do not contribute to a disadvantageous increase in the structural depth of the housing.

The end faces of the hooks are advantageously outwardly inclined to the collar of the snap-on sleeve. Upon insertion of the snap-on sleeve into the hub of the housing, the slanting faces slide along at the entry opening and are thus radially pressed in. This considerably facilitates assembly since only an axial pressure has to be exerted onto the snap-on sleeve in order to conduct the hooks through the axial opening of the hub.

Four hooks are preferably held at the snap-on sleeve offset by 90° relative to one another. The retaining force is thus symmetrically and uniformly distributed. The snap-on sleeve is provided with an inside projection that engages into a corresponding axial recess of the drive shaft. This inside projection has a cross-like section which engages into a corresponding longitudinal recess of the drive shaft.

The worm preferably comprises only one turn. This fashioning facilitates the insertion of the vertical axis or shaft together with the pinion formed of one piece therewith. The vertical axis or shaft first has its end bearing peg introduced at a slant into two axially offset bearing half-shells, whereupon the second bearing peg is latched into the lower second bearing shell provided with an axial slot being latched thereinto with a lateral pressure. On the basis of a slight rotation, the pinion thereby comes into engagement with the sole turn of the worm.

In accord with an embodiment of the invention, the pinion of the vertical axis or shaft with which the worm meshes only extends over a partial circumference of the vertical axis or shaft and is limited at both sides by a respective detent. As soon as the worm is seated against one of the detents, the friction clutch between the snap-on sleeve and the worm begins to function so that a further rotation of the drive shaft remains without effect.

Further advantages, details and features critical to the invention derive from the following description of a preferred embodiment of the worm drive of the invention with reference to the attached drawings.

These and other objects of this invention will become apparent from the following disclosure and appended claims.

DESCRIPTION OF THE PREFERRED EMBODIMENT

Figure 1:
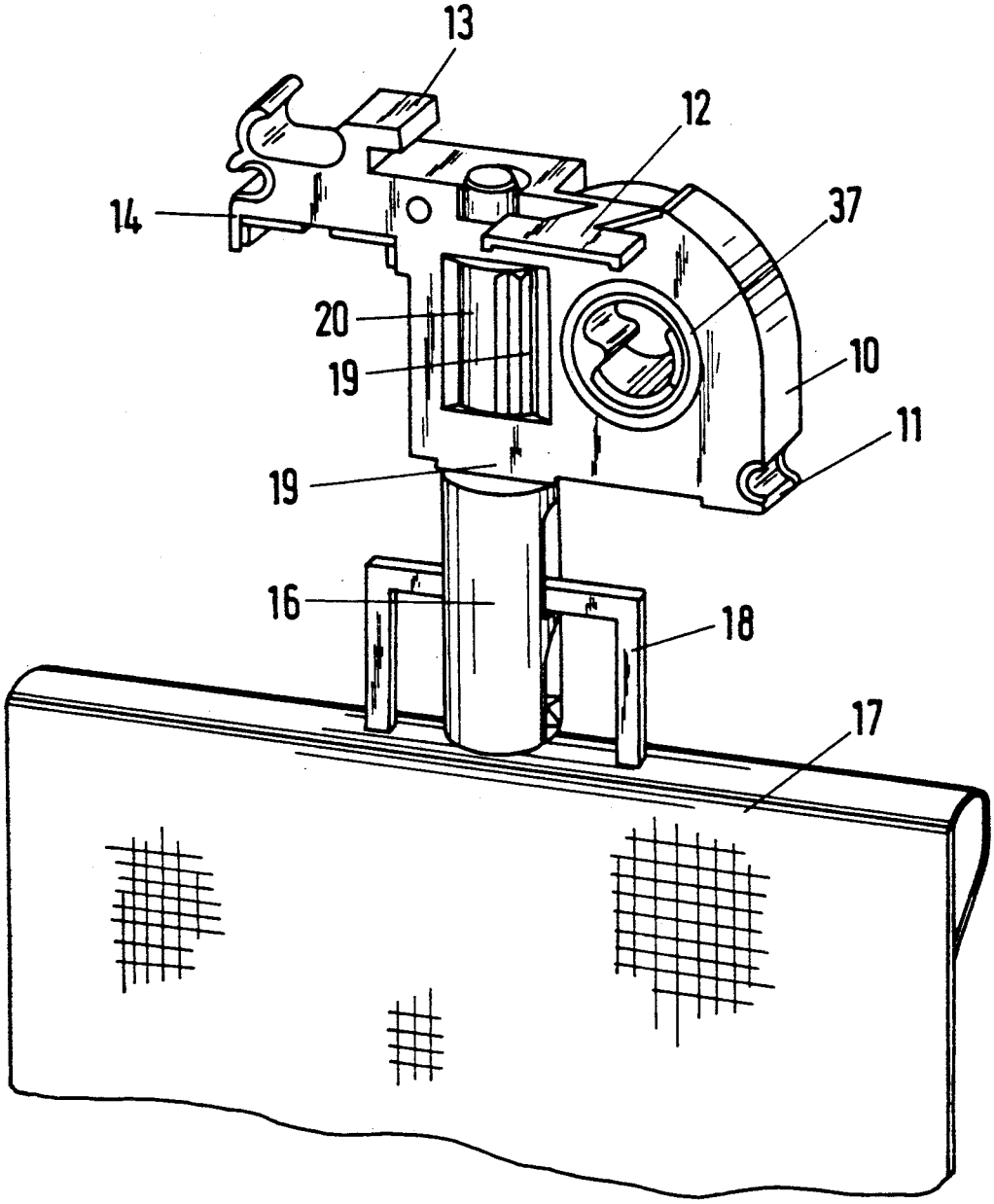
FIG. 1 is a perspective view of a slat carrier housing fitted with the worm drive of the invention, said slat carrier housing comprising a vertical axis or shaft and attached slat and being shown obliquely from behind.

The structure and functioning of the vertical slat blind shall first be briefly explained with reference to the illustration in FIG. 1. By way of a slideway 11, 12, 13 and 14, the slat carrier housing 10 is seated in the inside profile of a carrying rail that is not shown here and is displaced along the carrying rail by way of manual or motor drive. A vertical axis or shaft 15 is rotatably seated in the housing 10 and carries a slat mount or a hook 16 at its lower end for the acceptance of a clip 18 held at the slat 17.

The vertical axis or shaft 15 includes a pinion 19 fashioned of the same material that, however, extends only over half the circumference of the vertical axis or shaft 15 since the slat 17 itself is not to be pivoted farther than an angle of 180°. The pinion is limited by at least one detent 20 at the circumference of the vertical axis or shaft 15.

The adjustment of the angular position of the vertical axis or shaft 15 and, thus of the slat 17, ensues via a worm drive that shall be set forth in greater detail below with references to FIGS. 2 through 7.

Figure 2:
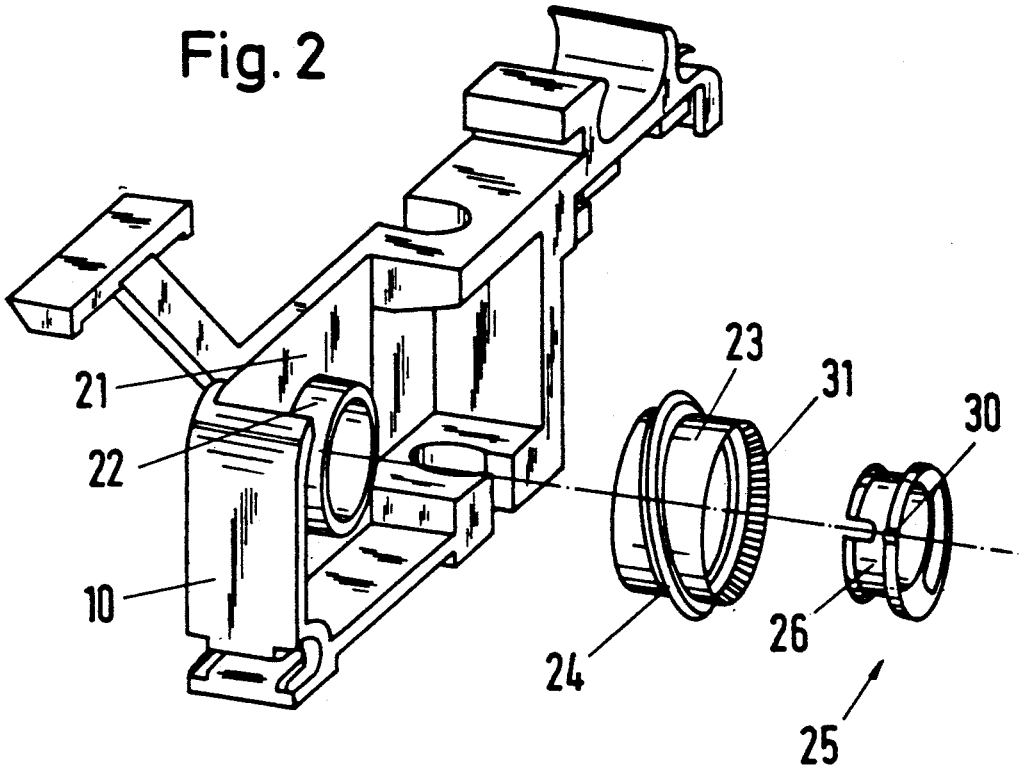
FIG. 2 is a perspective view of the slat carrier housing seen obliquely from the front with an exploded view of the drive.

As FIG. 2 shows, a projection 22 shaped like a connecting piece projects from the back wall 21 of the slat carrier housing 10 that has no front terminating wall, projecting in forward direction into the interior of the housing 10 that forms the hub for the worm 23. The worm 23 comprises only a single turn 24. The diameter of the hub 22 is only slightly smaller than the inside diameter of the worm 23 so that the latter is able to turn easily thereon.

The worm 23 is held on the hub 22 of the housing 10 with a snap-on sleeve 25. Radially resilient hooks 26 extend through the axial recess of the hub 22 and spring radially out into an all-around recess or counterbore 37 at the back side of the back wall 21 of the housing 10, as seen in from FIG. 1.

Figure 3:
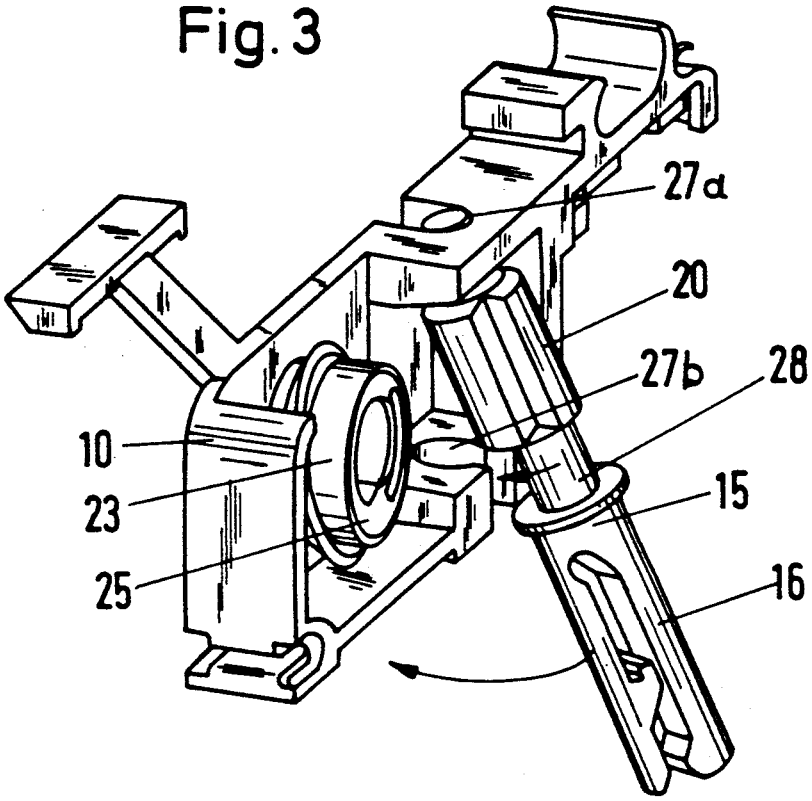
FIG. 3 is an illustration corresponding to FIG. 2 and comprising the mounted worm drive.

FIG. 3 shows the worm drive in the assembled condition, whereby the worm 23 is firmly, but rotatably, held on the hub by the snap-on sleeve 25.

The vertical axis or shaft 15 is obliquely inserted into two axial offset bearing half-shells 27*a* and 27*b* of the housing 10 whereupon, as indicated with arrows in FIG. 3, the lower bearing peg 28 is latched into the lowered bearing shell 27*a* provided with an axial slot using lateral pressure. The pinion 19 thereby comes into engagement with the turn 24 of the worm 23.

Figure 4:
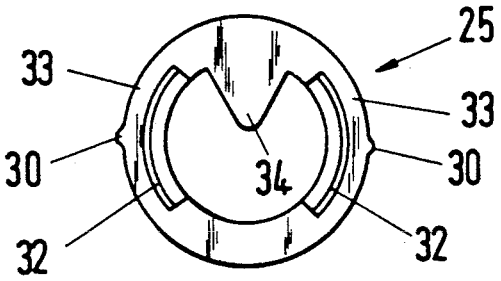
FIG. 4 shows the front view of a snap-on sleeve.
Figure 6:
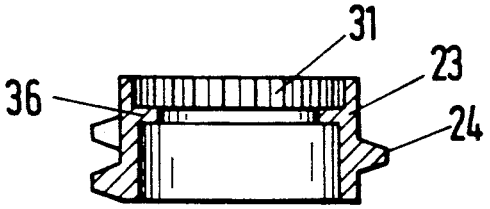
FIG. 6 shows an axial section through a worm.

It is seen in the front view of the snap-on sleeve 24 shown in FIG. 4 that this carries two cams 30 at the outside circumference of the collar that are in engagement with the inside dentation 31 of the worm 23 shown in section in FIG. 6. The snap-on sleeve 25 is provided with two recesses 32 at a distance from the outer circumference that lie opposite one another and are shaped like the segment of a circle, spring clips 33 that carry the cams 30 being thereby formed. The cams 30 are thus in resilient engagement with the inside dentation 31 of the worm 23 so that only a predetermined torque is transmitted.

The snap-on sleeve 35 also has its inside provided with a projection 34 shaped like the segment of a circle for positive engagement with the drive shaft (not shown in the drawings) that is provided with a corresponding longitudinal recess.

Figure 5:
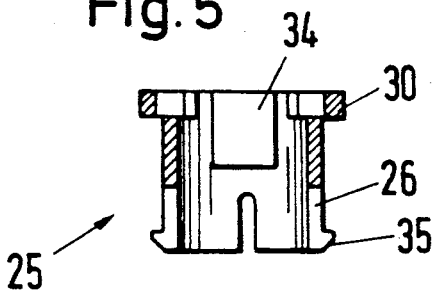
FIG. 5 shows an axial section through a snap-on sleeve.

It becomes clear from FIG. 5 that the snap-on sleeve 25 is provided with hooks 26 extending in axial direction proceeding from the collar of the snap-on sleeve 25. The hooks 26 have a terminating surface 27 outwardly inclined toward the collar that facilitates the insertion of the snap-on sleeve 25 into the hub 22, whereby the hooks 26 are guided radially inward.

Adjacent to the inside dentation 31, the worm 23 carries an annular flange 36 against which the snap-on sleeve 25 lies when it extends through the worm 23 and the hub 22.

Figure 7:
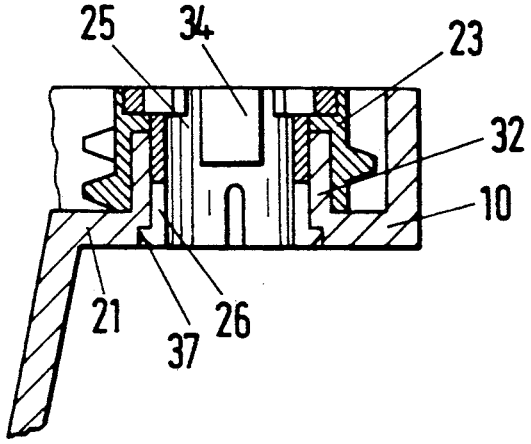
FIG. 7 is the worm drive mounted in the housing, shown in section.

FIG. 7 shows a section through the housing 10 with the assembled worm drive. The worm 23 is put in place onto the hub 22 and the snap-on sleeve 25 has its hook 26 engaging into the annular recess 37 at the back side of the back wall of the housing 10.

It should again be emphasized at this point that the above description is merely a description having exemplary character and that various modifications and variations are possible without thereby departing from the framework of the invention. Thus, in particular, it is possible to give the snap-on sleeve 25 some other outside profiling that is in engagement with the inside dentation 31 of the worm without thereby significantly influencing the function. The snap-on sleeve 25, for instance, can also be provided with a plurality of radially resilient hooks.

Although the invention has been described with respect to preferred embodiments, it is not to be so limited as changes and modifications can be made which are within the full intended scope of the invention as defined by the appended claims.

We claim as our invention:

1. A worm drive for setting the angular position of vertical slat blinds comprising means defining a vertical axis arranged inside a slat carrier housing, said means defining said vertical axis carrying a pinion torsionally connected thereto and having an end side joined to a slat, whereby a worm turnable by way of an inside profiling is in drive engagement with the pinion, characterized in that the worm comprises an axial center opening and is held on a connection-piece-shaped projection of the slat carrier housing with a snap-on sleeve.

2. A worm drive for setting the angular position of vertical slat blinds comprising means defining a vertical axis arranged inside a slat carrier housing, said means defining said vertical axis carrying a pinion torsionally connected thereto and having an end side joined to a slat, whereby a worm turnable by way of an inside profiling is in drive engagement with the pinion, characterized in that the worm comprises an axial center opening and is held on a connection-piece-shaped projection of the slat carrier housing with a snap-on sleeve and wherein the worm carries an all-around inside dentation that is in engagement with an outside profiling of the snap-on sleeve.

3. A worm drive according to claim 2, characterized in that the inside dentation of the worm is arranged in an all-around recess and the outside profiling of the snap-on sleeve is formed by cams directed outward from its collar.

4. A worm drive according to claim 3, characterized in that a plurality of spring clips is provided each holding a cam.

5. A worm drive according to claim 4, characterized in that each of the spring clips are composed of a circumferential part of the snap-on sleeve that is cut free.

6. A worm drive according to claim 2, characterized in that the snap-on sleeve carries axially positive resilient radial hooks that engage behind the back wall of the slat carrier housing.

7. A worm drive according to claim 6, characterized in that the hooks of the snap-on sleeve engage into an all-around recess at the back side of the back wall of the slat carrier housing.

8. A worm drive according to claim 6, characterized in that the end surface of the hooks are outwardly inclined to the collar of the snap-on sleeve.

9. A worm drive according to claim 8, characterized in that four hooks are held at the snap-on sleeve respectively offset by 90° relative to one another.

10. A worm drive according to claim 9, characterized in that the snap-on sleeve comprises an inside projection.

11. A worm drive according to claim 10, characterized in that the cross section of the inside projection is fashioned essentially in the shape of the sector of a circle.

12. A worm drive according to claim 2, characterized in that the worm comprises only one worm turn.

13. A worm drive according to claim 2, characterized in that the pinion of the vertical axis with which the worm is in engagement extends only over a partial circumference of the vertical axis and is limited at both sides by a respective detent.

14. A worm drive for setting the angular position of vertical slat blinds comprising:

a slat carrier housing;

means inside said housing defining a vertical axis;

pinion means connected to said vertical axis defining means;

said vertical axis means having an end side for connection to a slat;

a worm journalled inside of said housing, turnable with respect thereto and constructed to drivingly engage said pinion means;

wherein the improvement is characterized by:

said worm having a central axial opening and journalled to said carrier by a snap-on sleeve constructed to engage both the carrier housing and the worm.

15. A system for carrying and rotating a vertically oriented venetian blind type slat which includes:

a housing having a side wall, a cylindrical boss-like projection integral with the side wall and extending into the housing from said side wall, and there being a drive opening extending through the projection and side wall;

a sleeve-like worm gear rotatably mounted on the projection;

a sleeve-like retainer member constructed to engage the projection and fit within the opening thereof, and engage and position the worm gear;

a pinion gear assembly for engagement with the worm gear and rotation of a slat, said assembly operatively journalled to said housing and having a pinion gear at one end for engagement with the worm gear and rotation thereby, and a shaft at the other end for engagement with the slot and rotation thereof;

whereby rotation of the worm gear rotates the pinion gear assembly and thus the connected slat.

* * * * *